US009555937B2

(12) United States Patent
Houghton

(10) Patent No.: US 9,555,937 B2
(45) Date of Patent: Jan. 31, 2017

(54) FILLING SYSTEM FOR A BOTTLE WITH A ROTARY SPORTS VALVE

(71) Applicant: WHITE HORSE INNOVATIONS LTD, Stanford-in-the-Vale (GB)

(72) Inventor: Rod Houghton, Stanford-in-the-Vale (GB)

(73) Assignee: WHITE HORSE INNOVATIONS LTD, Stanford-in-the-Vale (GB)

( * ) Notice: Subject to any disclaimer, the term of this patent is extended or adjusted under 35 U.S.C. 154(b) by 302 days.

(21) Appl. No.: 14/355,862

(22) PCT Filed: Dec. 3, 2012

(86) PCT No.: PCT/GB2012/052989
§ 371 (c)(1),
(2) Date: May 2, 2014

(87) PCT Pub. No.: WO2013/079978
PCT Pub. Date: Jun. 6, 2013

(65) Prior Publication Data

US 2014/0290793 A1 Oct. 2, 2014

(30) Foreign Application Priority Data

Dec. 2, 2011 (GB) ..... 1120778.4

(51) Int. Cl.
*B65D 47/06* (2006.01)
*B65D 47/24* (2006.01)

(52) U.S. Cl.
CPC ..... *B65D 47/06* (2013.01); *B65D 47/242* (2013.01)

(58) Field of Classification Search
CPC ..... B65D 47/06; B65D 47/241; B65D 47/242; B65B 3/04; B65B 7/16; B67C 3/02; B67C 2007/006

(Continued)

(56) References Cited

U.S. PATENT DOCUMENTS 3,273,610 A * 9/1966 Frost ..... B65D 83/14 141/353
4,929,818 A 5/1990 Bradbury et al.
(Continued)

FOREIGN PATENT DOCUMENTS

EP 0725035 A1 8/1996
GB 995486 A 6/1965
(Continued)

OTHER PUBLICATIONS

International Search Report and Written Opinion dated Mar. 5, 2013 in corresponding International Application No. PCT/GB2012/052989.

(Continued)

*Primary Examiner* — Nicolas A Arnett
(74) *Attorney, Agent, or Firm* — The Law Office of Michael E. Kondoudis

(57) ABSTRACT

A filling mechanism for use with a nozzle. The nozzle includes a nozzle body and an end cap, which are axially aligned with one another. The end cap includes a fluid opening and the nozzle body includes a closing member. In a first position, the closing member seals the opening. In a second position, the opening is spaced from the closing member so as to allow the flow of fluid through the opening. The filling mechanism includes opening/closing means, adapted to effect axial movement of the nozzle body and the end cap relative to one another between the first and second positions, and a filling tube. The filling mechanism is arranged such that the filling tube and the fluid opening in the end cap of the nozzle are brought into fluid communication with one another by relative axial movement of the nozzle body and end cap.

18 Claims, 15 Drawing Sheets

(58) Field of Classification Search
USPC ..... 141/18, 351, 353, 392; 53/268, 467–468
See application file for complete search history.

(56) References Cited

U.S. PATENT DOCUMENTS

| | | | | |
|---|---|---|---|---|
| 4,941,598 | A * | 7/1990 | Lambelet, Jr. | B05B 11/3004 222/321.6 |
| 4,964,548 | A * | 10/1990 | Kenyon, Jr. | B65D 47/242 222/521 |
| 5,284,277 | A * | 2/1994 | Leuenberger | B65D 47/242 222/521 |
| 5,305,932 | A * | 4/1994 | Iseli | B65D 47/242 222/521 |
| 5,310,097 | A * | 5/1994 | Leuenberger | B65D 47/242 222/521 |
| 5,423,791 | A * | 6/1995 | Bartlett | A61J 1/2096 604/403 |
| RE35,187 | E * | 3/1996 | Gortz | B65D 83/0061 222/105 |
| 5,641,004 | A * | 6/1997 | Py | B65B 3/003 141/10 |
| 6,065,651 | A * | 5/2000 | Tedeschi, Jr. | B65D 41/3409 222/519 |
| 6,168,037 | B1 * | 1/2001 | Grimard | A61J 1/2096 215/249 |
| 6,196,282 | B1 * | 3/2001 | Mollers | B65B 3/04 141/113 |
| 6,290,108 | B1 * | 9/2001 | Gross | B65D 47/242 222/212 |
| 6,351,924 | B1 * | 3/2002 | Gustafsson | A61L 2/186 53/425 |
| 6,446,844 | B1 * | 9/2002 | Gross | B65D 47/2031 222/212 |
| 6,578,763 | B1 | 6/2003 | Brown | |
| 6,629,624 | B2 * | 10/2003 | Stillinger | B65D 47/2025 220/254.7 |
| 6,631,823 | B2 * | 10/2003 | Stillinger | B65D 47/2025 220/714 |
| 7,077,176 | B2 * | 7/2006 | Py | A61J 1/1412 141/301 |
| 7,121,437 | B2 * | 10/2006 | Kasting | B65D 47/24 220/726 |
| 7,131,468 | B2 * | 11/2006 | Schuman | B01F 13/1055 141/100 |
| 7,568,509 | B2 * | 8/2009 | Py | A61J 1/1412 141/301 |
| 2004/0020723 | A1 * | 2/2004 | Schuman | B01F 13/1055 186/52 |
| 2004/0159680 | A1 * | 8/2004 | Krohn | B65D 35/08 222/212 |
| 2010/0108724 | A1 * | 5/2010 | Buchalter | B65D 47/242 222/521 |

FOREIGN PATENT DOCUMENTS

| | | | |
|---|---|---|---|
| GB | 1216656 | A | 12/1970 |
| WO | 90/05091 | A1 | 5/1990 |
| WO | 99/10677 | A1 | 3/1999 |
| WO | 03/095354 | A1 | 11/2003 |
| WO | 2005097664 | A1 | 10/2005 |
| WO | 2008146965 | A1 | 12/2008 |
| WO | 2011100937 | A1 | 8/2011 |

OTHER PUBLICATIONS

Intellectual Property Office Search Report dated Mar. 14, 2012 in related UK Application No. GB1120778.4.

* cited by examiner

SECTION A-A

FILLING SYSTEM FOR A BOTTLE WITH A ROTARY SPORTS VALVE

The present disclosure relates to a nozzle, to a fluid container comprising the nozzle, to a filling mechanism suitable for filling a container featuring the nozzle and to a system that includes the nozzle and the filling mechanism.

In recent years, sales of bottled water have increased greatly. Water is typically sold in disposable plastic bottles. The bottles are filled at source and transported to the points of sale. The bottles are provided with removable caps.

The filling and subsequent transport of bottles is not cost effective and increases the environmental impact greatly. Moreover, the disposable bottles, which are generally provided with conventional rotary caps or rotary "sports" caps, which feature a nozzle, may be refilled, which can be unhygienic. Furthermore, since the caps can be removed from the bottles, there can be a further environmental impact due to an increase in litter and/or less convenient recycling, with caps discarded separately to bottles.

The present invention arose, primarily, in a bid to provide an improved container that may be easily and hygienically filled at the point of sale/use and to a filling mechanism therefor.

According to the present invention, in a first aspect, there is provided a filling mechanism for use with a nozzle, the nozzle comprising a nozzle body and an end cap, which are axially aligned with one another, the end cap comprising a fluid opening and the nozzle body comprising a closing member, wherein in a first, closed, position the closing member is arranged to seal the opening, and in a second, open, position the opening is spaced from the closing member, so as to allow the flow of fluid through the opening, and the end cap and nozzle body are interconnected such that axial movement of the end cap relative to the nozzle body, between the first and second positions, is achieved by rotation of the nozzle body and the end cap relative to one another about the axis; the filling mechanism comprising rotation means, adapted to effect rotation of the nozzle body and the end cap relative to one another, and a filling tube; the filling mechanism being arranged such that the filling tube and the fluid opening in the end cap of the nozzle are brought into fluid communication with one another by rotation of the nozzle body and end cap relative to one another.

The rotation means is preferably arranged to apply a rotational force to the end cap.

The position and/or orientation of the filling tube is preferably fixed. The filling tube is preferably arranged to engage the end cap when the nozzle is in the second, open, position only. The filling tube is preferably maintained in spaced relation to the end cap prior to rotation of the nozzle body and end cap relative to one another. The filling tube may be mounted such that it may move away from the end cap along its axial direction and be resiliently biased towards the end cap, wherein with rotation of the nozzle body and end cap relative to one another, the end cap and filling tube are brought into engagement with one another and the end cap applies a counter force to the filling tube against the biasing force. A sensor may be provided, which is arranged to sense correct engagement of the filling tube with the end cap. The sensor may be arranged to sense the travel of the filling tube along its axial direction. The filling tube is preferably arranged to sealingly engage with the opening in the end cap when the nozzle is in the second, open, position. The outer surface of the filling tube may be tapered at the leading edge of the filling tube.

A locking mechanism may be provided, which is arranged to engage the nozzle body in use, to fix the position of the nozzle body. The locking mechanism is preferably arranged to lock the nozzle body at a predetermined distance from the end of the filling tube, prior to relative rotation of the end cap and nozzle body relative to one another, and to lock the opening in the end cap in axial alignment with the filling tube.

The mechanism as defined above is preferably arranged to: a) receive the nozzle in the first, closed, state; b) apply a rotational force to the end cap to place the nozzle in the second, open position; c) dispense a predetermined volume of fluid from the filling tube, through the opening in the end cap of the nozzle; and d) apply a counter-rotational force to the end cap to return the nozzle to the first, closed, position.

Where a locking mechanism is provided, as detailed above, the locking mechanism is preferably arranged to lock the nozzle body before or simultaneously with step (b) and to unlock the nozzle body after or simultaneously with step (d). Further, the locking mechanism may be arranged to lock the rotation means for the duration of step (c).

The locking mechanism preferably comprises a pair of locking members that oppose one another and combine to form jaws that grip the nozzle body during use. The locking members may be resiliently biased towards each other.

The locking members preferably comprise pivotally mounted plates, which lie is the same plane as one another, substantially parallel to one another, and at a predetermined spacing from one another.

The locking means may comprise at least one locking element, which is arranged to be brought into and out of engagement with the locking members to selectively lock the orientation of the locking members relative to one another. The locking element may comprise a pin. The locking member may comprise the bolt of the solenoid.

The locking members are preferably each provided with a cutout, the cutouts being arranged to combine with one another to provide an opening which conforms substantially to the profile of the outer surface of the nozzle body, and wherein the cutout has its centre in alignment with the axis of the filling tube.

The locking members preferably have a depth in the axial direction that is substantially equal to the distance between a pair of collars that are provided on the nozzle body, the arrangement being such that the locking members are sandwiched between the collars on the nozzle body, when the nozzle body is engaged with the locking members to prevent axial movement of the nozzle body relative to the filling tube.

The locking mechanism is preferably provided at a fixed distance from the lowest position of the filling tube.

The first locking member may be a fixed member and the second locking member may be moveable towards and away from the first locking member. The first locking member may comprise a plate. The second locking member may comprise a pivotally mounted door. The locking members may each be provided with a cutout, the cutouts being arranged to combine with one another in a closed position to provide an opening which conforms substantially to the profile of the outer surface of the nozzle body, and wherein the cutout has its centre in axial alignment with the axis of the filling tube. Means may be provided for locking the first and second locking members relative to one another in a closed position. The means may comprise a solenoid or an electromagnet. A sensor may be provided, which is arranged to sense the closed position of the locking members.

The rotation means may be motor driven. The rotation means preferably comprises a rotation element that is arranged to engage the end cap on one half of the end cap only, such that the rotation element is open on one side and the nozzle may be brought into engagement with the rotation element by translational movement of the nozzle at an angle to the axis of the filling tube. Most preferably, the nozzle may be brought into engagement with the rotation element by translational movement in a direction substantially perpendicular to the axis of the filling tube.

The rotation means may be arranged to limit rotation of the nozzle body and end cap relative to one another within predetermined limits. The rotation means is preferably arranged to limit rotation of the nozzle and end cap to 180 degrees.

A centerline of the rotation element is preferably aligned with a centerline of a mouth of the locking mechanism and the longitudinal axis of the filling tube.

Means may be provided for preventing refilling of a container provided with the nozzle. The nozzle may be provided with a tab that is arranged to activate a switching element when the nozzle is inserted into the filling mechanism. A control means may be provided that is arranged to prevent filling unless a signal is received from the switching element indicating that the tab is present. An element may be provided for deforming or removing the tab from the nozzle following activation of the switching element. The tab may be plastic, integrally formed with the nozzle body. The tab preferably radially protrudes from the nozzle body.

According to the present invention is a further aspect, there is provided a filling system comprising a filling mechanism as defined in any of the paragraphs above in combination with a fluid container provided with the nozzle. The nozzle body may be permanently and sealingly attached to the container. Preferably, the fluid container is formed from the same material as the nozzle, such that the nozzle, in its entirety, and the container may be recycled together as a single element. The fluid container may comprise a drinks container. The fluid container may comprise a flexible pouch.

Non-limiting embodiments of the invention will now be described, by way of example only, with reference to the accompanying drawings, in which.

Figure 7:
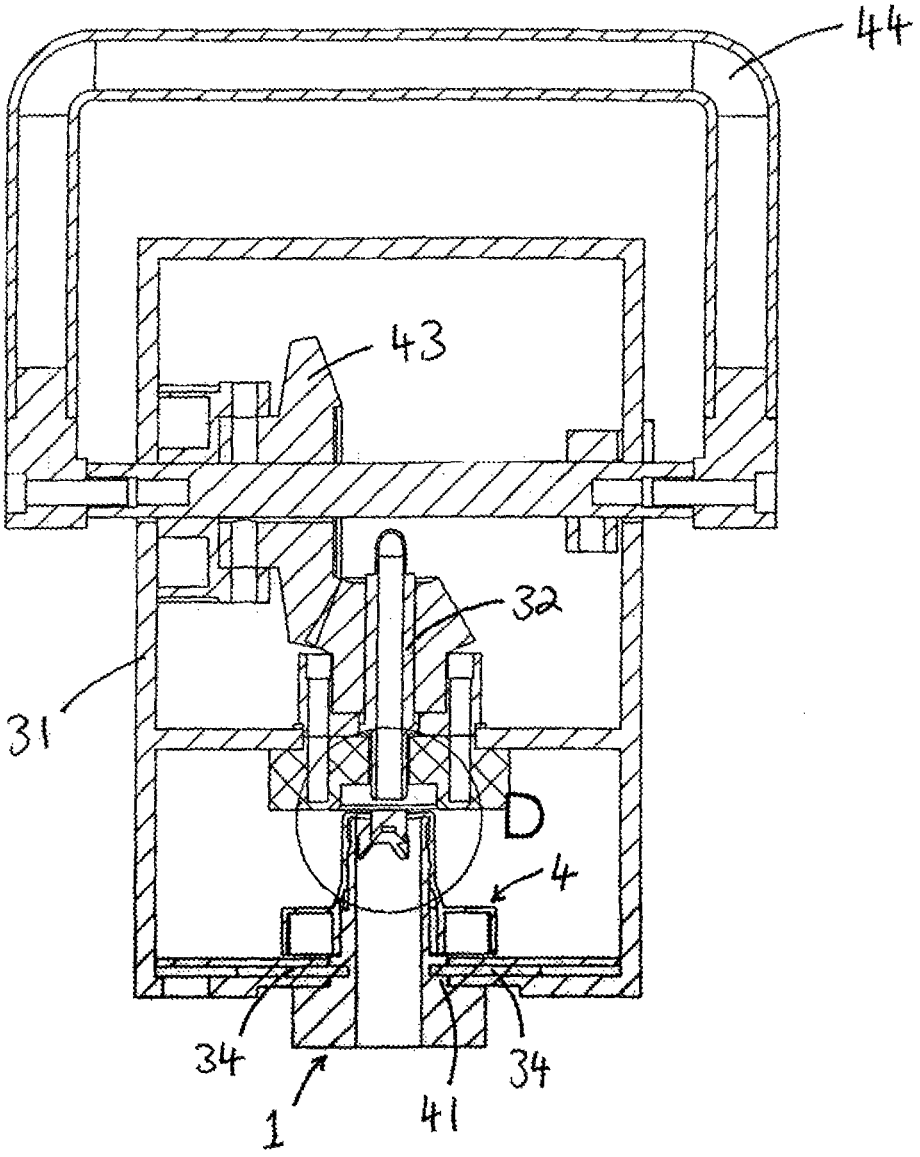
FIG. 7 shows a sectional view taken through axis X of the filling mechanism and looking forward, the filling mechanism being in an open state with the nozzle in situ.
Figure 7A:
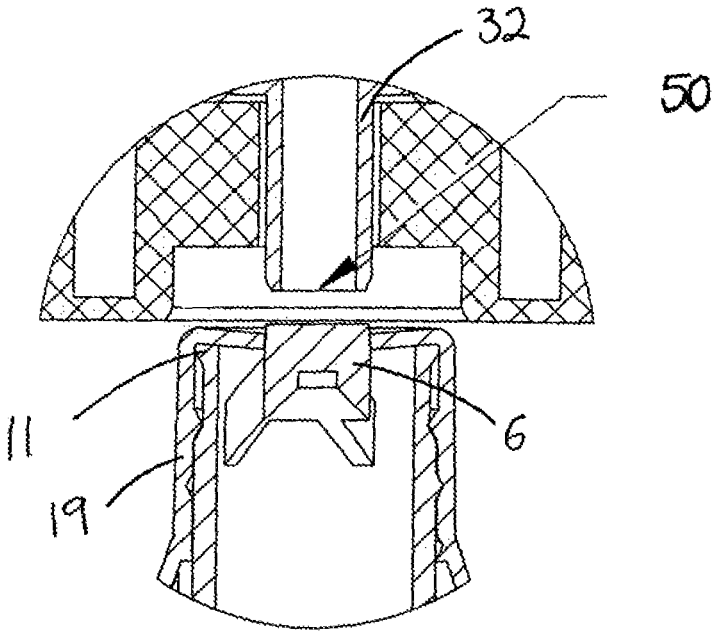
Figure 8:
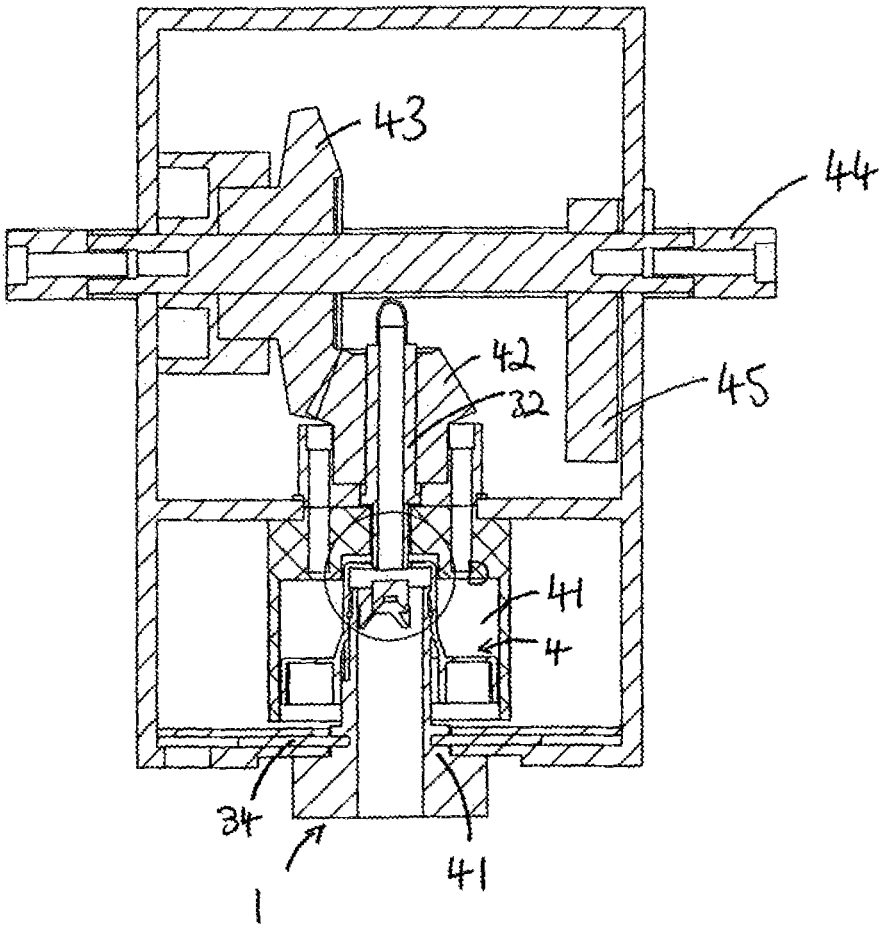
Figure 8A:
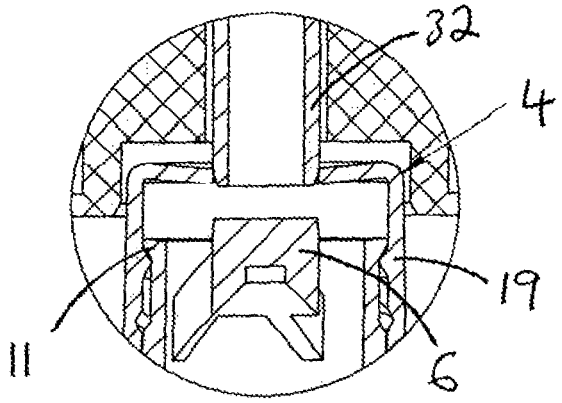
Figure 9:
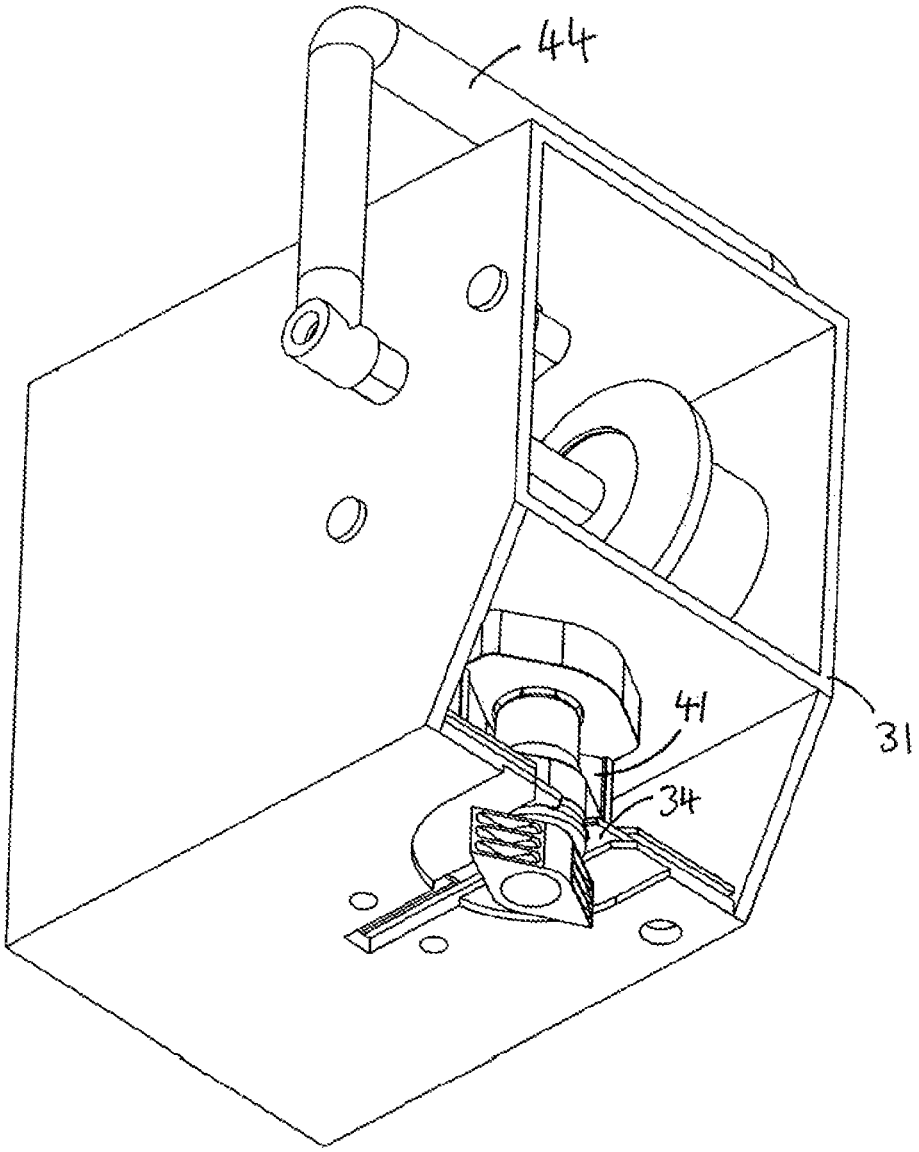
Figure 10:
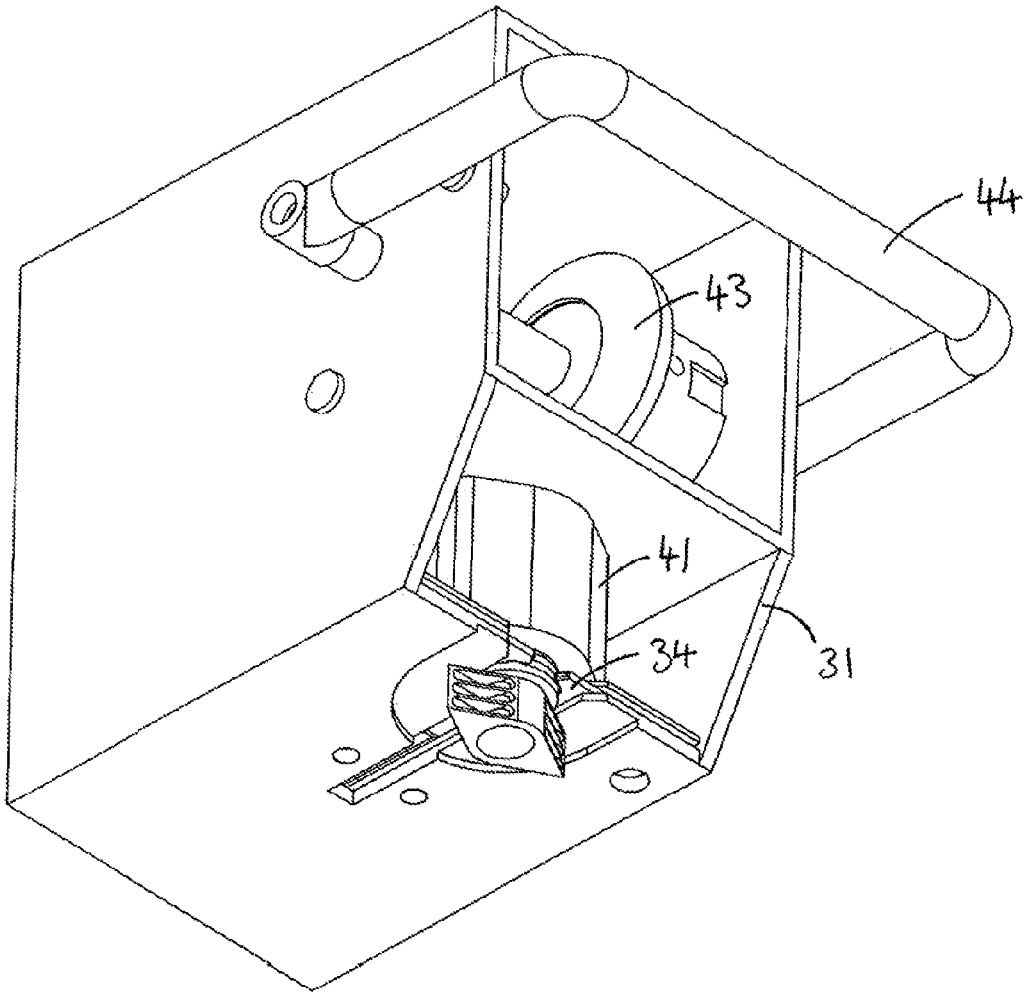
Figure 11:
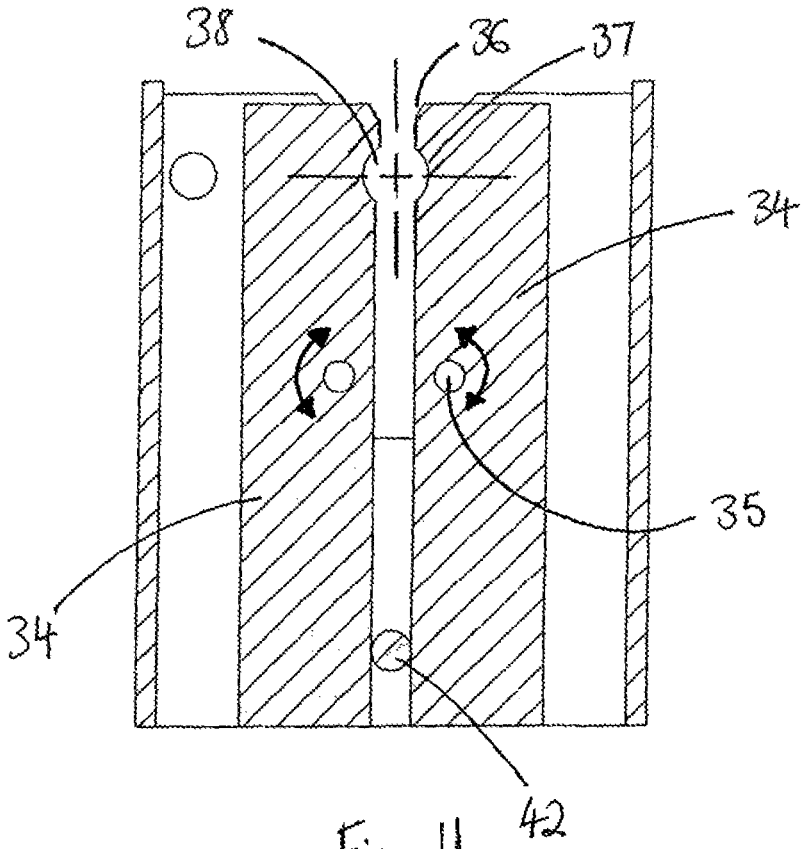
Figure 12:
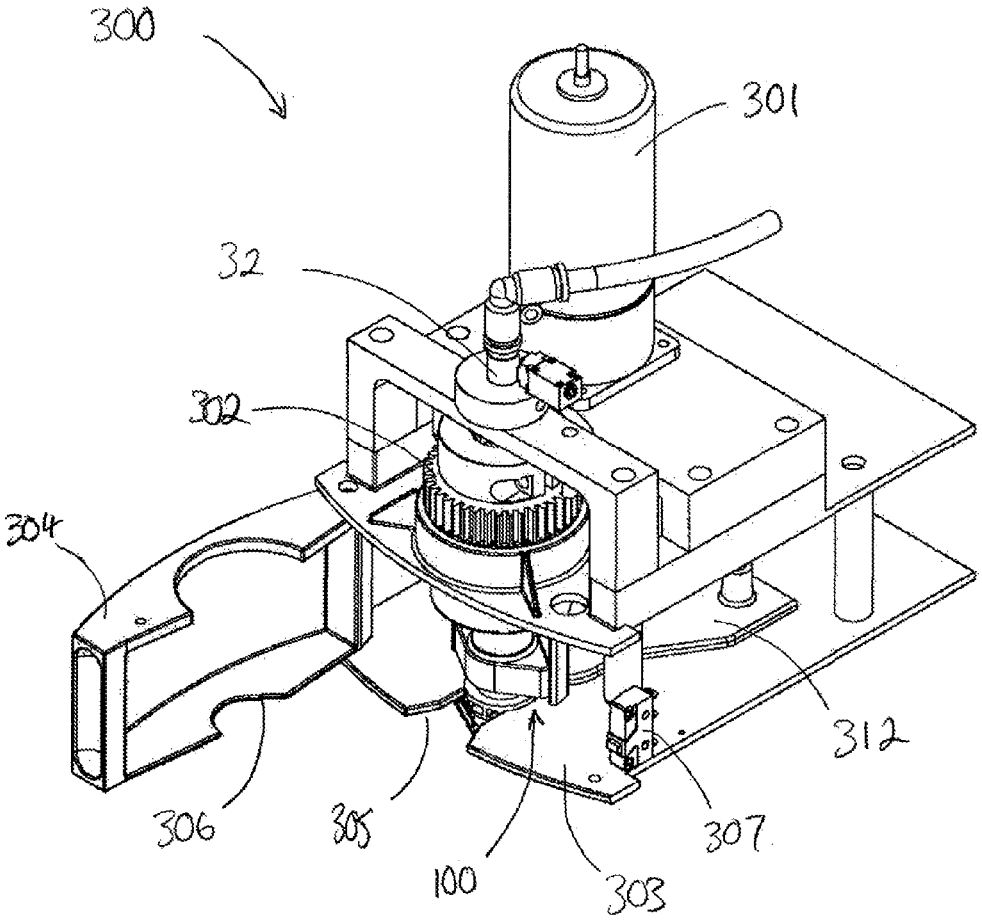
Figure 13:
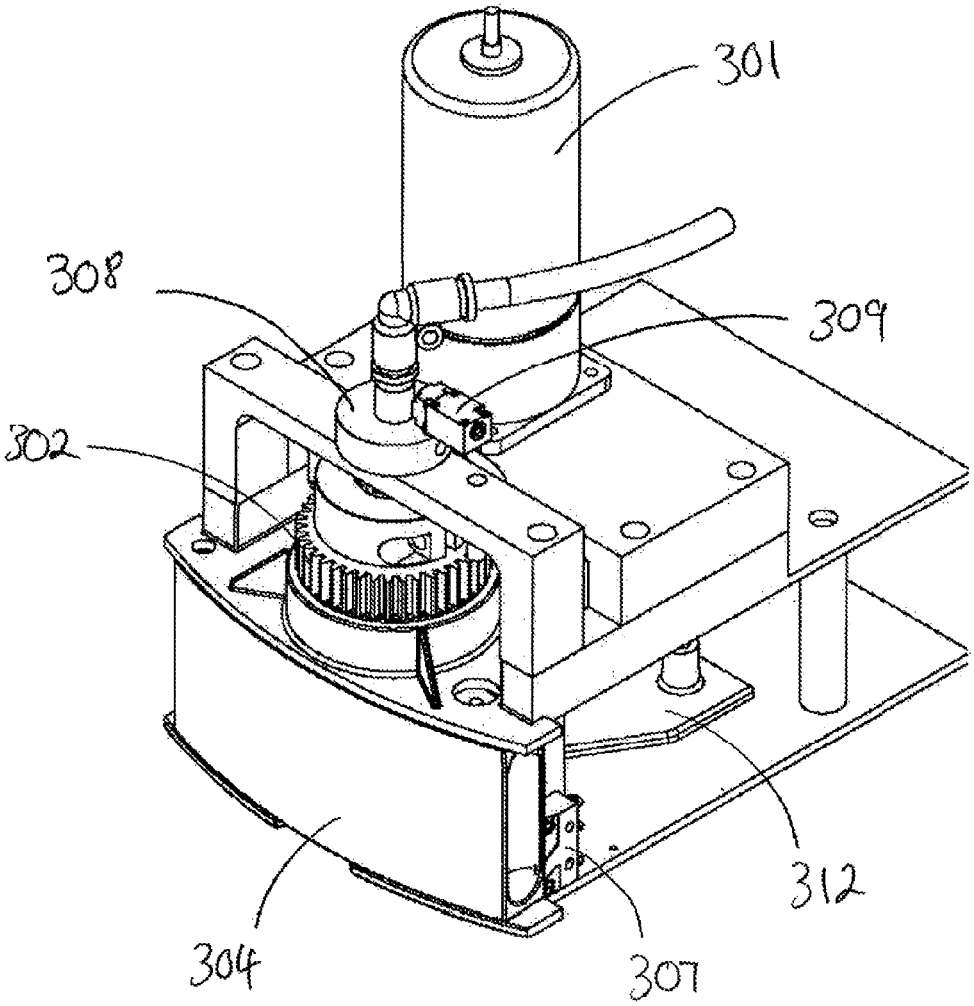
Figure 15:
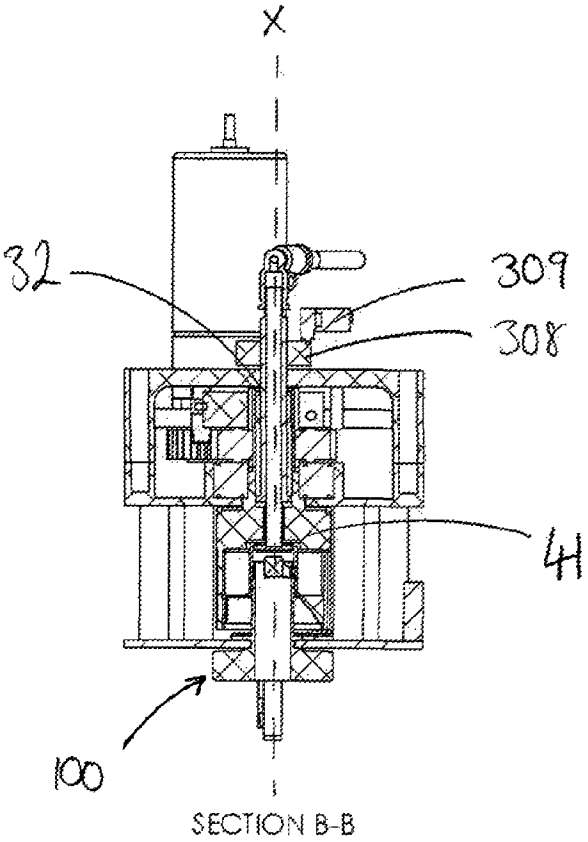
Figure 14:
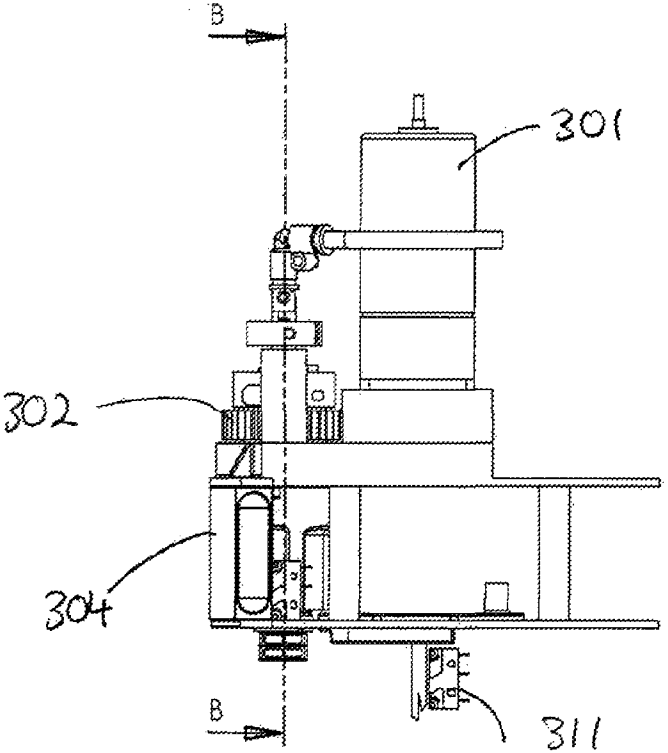
Figure 16:
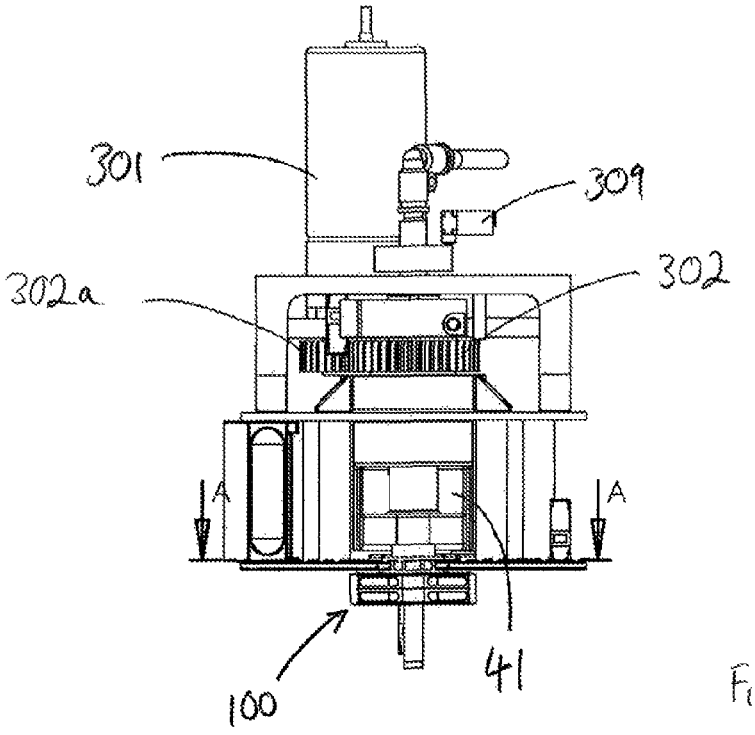
Figure 17:
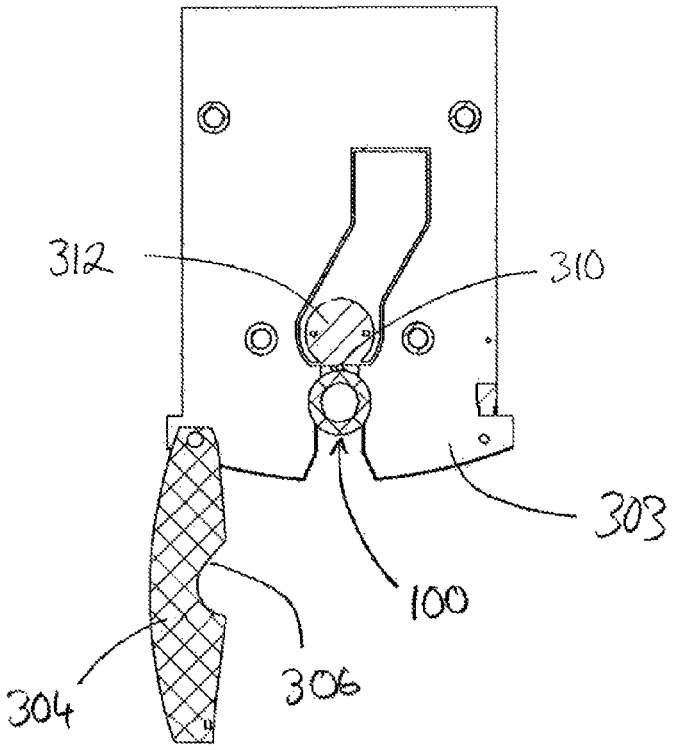

FIG. 7*a* shows an enlarged view of the detail circled in FIG. 7;

FIG. 8 shows a sectional view taken through axis X of the filling mechanism and looking forward, the filling mechanism being in an closed state with the nozzle in situ;

FIG. 8*a* shows an enlarged view of the detail circled in FIG. 8;

FIG. 9 shows a front perspective view from below of the filling mechanism in the open state with the nozzle in situ;

FIG. 10 shows a front perspective view from below of the filling mechanism in the closed state with the nozzle in situ;

FIG. 11 shows a sectional view of the locking mechanism taken through the plane of the locking plates and shows the locking mechanism in a locked position but without a nozzle in situ;

FIG. 12 shows a perspective view of an alternative filling mechanism with a nozzle in situ and with a door, which forms part of a locking mechanism, open;

FIG. 13 shows a perspective view of the filling mechanism of FIG. 12 with the door closed;

FIG. 14 shows a side view of the filling mechanism of FIG. 12;

FIG. 15 shows a front sectional view of the filling mechanism of FIG. 12, taken through the line B-B of FIG. 13;

FIG. 16 shows a front view of the filling mechanism of FIG. 12 with the door open; and FIG. 17 shows a plan sectional view of the filling mechanism of FIG. 12, taken through the line A-A of FIG. 16.

Referring to FIGS. 1 to 4, there is shown a nozzle 100. The nozzle comprises a nozzle body 1 and an end cap 4, which are axially aligned with one another about axis A. The end cap is provided with a fluid opening 5 and the nozzle body is provided with a closing member 6 that may close off the opening 5 to create a fluid tight seal.

Figure 3:
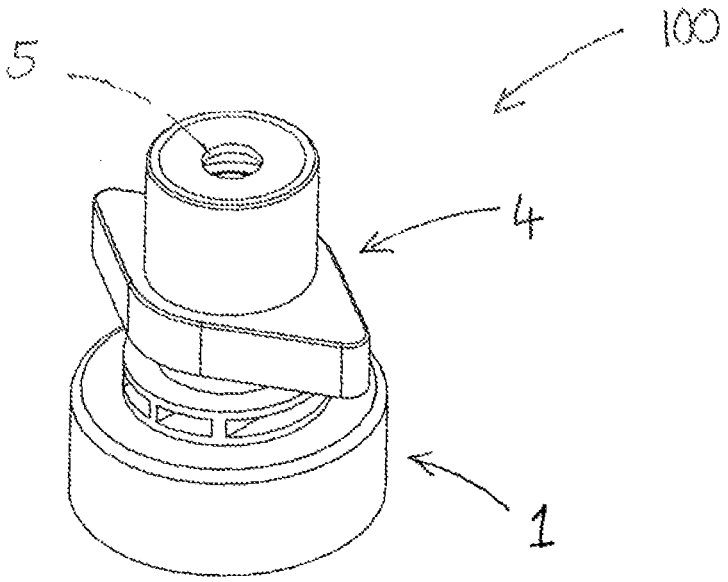
FIG. 3 shows a perspective view of a nozzle comprising the end cap and the nozzle body.
Figure 4:
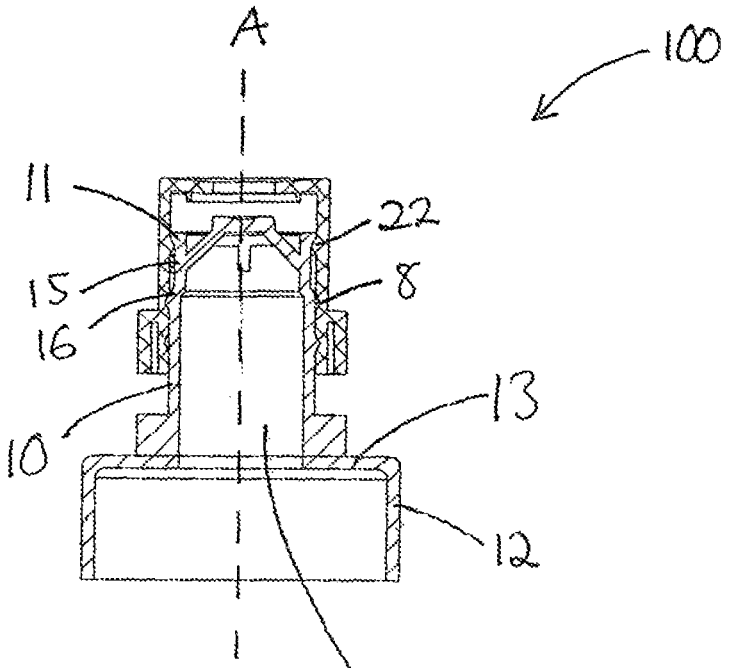
FIG. 4 shows a sectional view of the nozzle of FIG. 3.

In a first, closed, position the closing member 6 is arranged to seal the fluid opening 5, and in a second, open, position (as shown in FIGS. 3 and 4) the opening 5 is spaced from the closing member 6, so as to allow the flow of fluid out of the nozzle 100 through the opening 5. The nozzle body 1 and end cap 4 are threaded. In the present arrangement, the nozzle body 1 comprises a male thread 7 on its outer surface and the end cap 4 comprises a cooperating female thread 8 on its inner surface. In alternative arrangements the threads may be switched over. By virtue of the cooperating threads, movement of the end cap 4 relative to the nozzle body 1 along the axis A, between the first and second positions, is achieved by rotation of the nozzle body 1 and the end cap 4 relative to one another about the axis A.

The nozzle body 1 features a first part (neck) 2 and a second part (base) 3. In the present embodiment the nozzle body 1 is of unitary construction, with the neck and base co-formed as a single item. In alternative arrangements, however, the neck 2 and base 3 may be formed separately and joined to one another by adhesive or otherwise. The neck 2 and base 3 are preferably formed from the same recyclable plastic, such as, but not limited to, polyethylene or polypropylene. The base 3 is arranged to be attached to a fluid container (not shown). The neck 2 and base 3 of the present arrangement are each generally cylindrical. The neck 2 comprises a cylindrical wall 10 and the base comprises a cylindrical wall 12 that are joined by a shoulder 13. The neck 2 and base 3 are open at both ends such that a continuous opening 14 extends through the nozzle 100 for the flow of fluid from the fluid container (attached to the base) and out through the opening 5 in the nozzle cap.

It should be noted that the base is not limited to the cylindrical form of the depicted arrangement and may take numerous other forms in correspondence with the form of the container to which it is to be attached. When arranged for connection to a flexible pouch the base may take a diamond form, as shown most clearly in FIGS. 9 and 10.

The closing member 6 lies on the axis A within the opening 14 in the neck 2. It is located at the upper end of the nozzle body (at the end of the neck distal the base). It is circular and substantially disk-like in form. In alternative arrangements it may take different forms, as will be readily appreciated. It is supported by a plurality of radial support members 9 (four in the present arrangement, although more or less may be provided) each of which extends at an oblique angle to the axis A between an inner surface of the cylindrical wall 10 of the neck and the closing member 6, such that the closing member 6 lies above an upper edge of the cylindrical wall 10 of the neck 2. The four radial support members 9 are spaced from one another such that a flow path between the inner surface of the cylindrical wall 10 and the closing member 6 is provided, to allow for the flow of fluid past the closing member 6.

The end cap 4 features a cap 17 and a base 18. The cap 17 comprises a cylindrical wall 19 and is provided at its upper end (the end of the cylindrical wall distal the base 18) with a substantially flat end face 20 in which the opening 5 is provided. The opening 5 is circular, corresponding to the closing member 6, and is axially aligned with the closing member 6 when the end cap is mounted on the nozzle body. The thread 8 is provided on the inside face of the cylindrical wall 19. The base 18 comprises a pair of radially extending protrusions 21*a*, 21*b*, which combine to give the base 18 a substantially diamond-like shape in plan view. These radial protrusions allow a user and/or a filling mechanism (described in detail below) to turn the end cap 4 relative to the nozzle body 2 to close the nozzle 100 after dispensing fluid from the nozzle or filling fluid through the nozzle or to open the nozzle for dispensing or filling, i.e. to open and close the nozzle 100. The end cap is not, however, limited to the depicted arrangement. In particular, the radial protrusions may be omitted or may take alternative forms.

Figure 1:
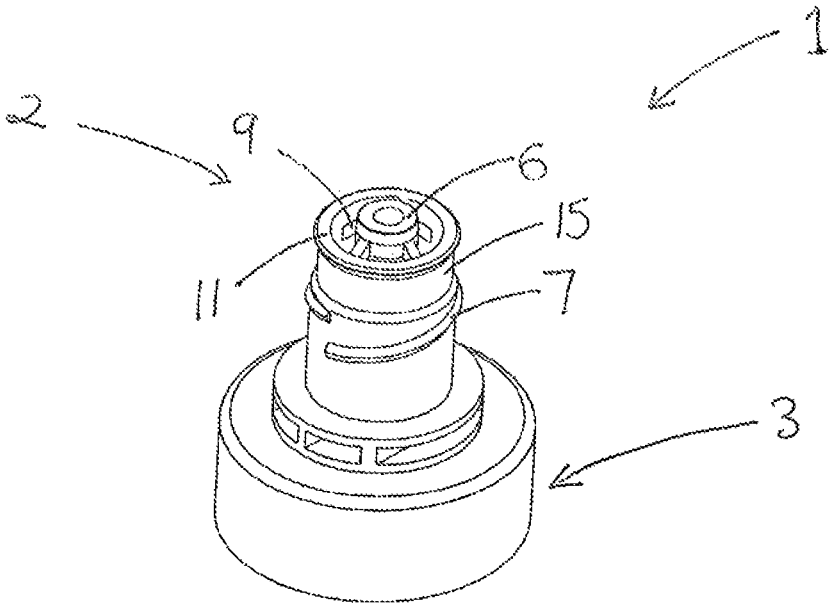
FIG. 1 shows a perspective view of a nozzle body.
Figure 2:
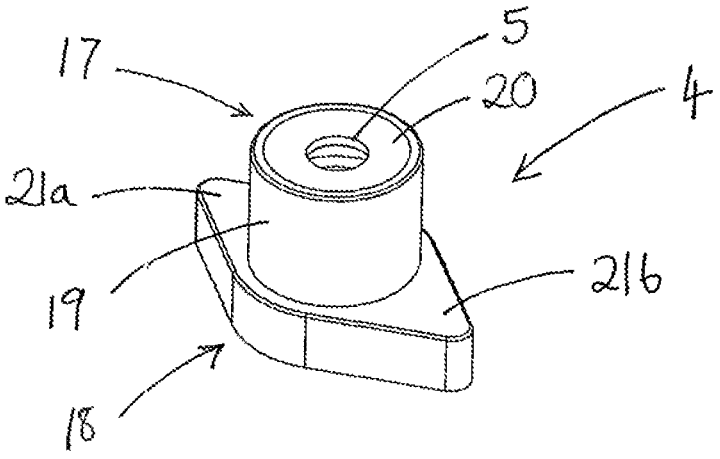
FIG. 2 shows a perspective view of an end cap.

At an upper end of the cylindrical wall member 10 of the nozzle body 1, there is provided a reduced diameter portion 15, as shown in FIGS. 1 and 4, which extends parallel to the axis A between a radially outwardly extending rim 11 at the upper end of the cylindrical wall 10 and a shoulder 16 that extends between the reduced diameter portion 15 and a lower region of the cylindrical wall 10 that is provided with the thread 7. The rim 11 and the shoulder 16 each feature faces that extend outwardly from the reduced diameter portion at an oblique angle to the reduced diameter portion (at around 45 degrees in the present arrangement). These faces are opposed to one another at opposed ends of the reduced diameter portion 15. Both the rim 11 and shoulder 16 extend continuously around the circumference of the cylindrical wall member 10.

On an inner face of the cylindrical wall 19 of the end cap 4, between the end face 20 and a top of the thread 8, there is provided a radially inwardly extending rim 22. The rim 22 is substantially wedge shaped, such that it features a pair of converging faces extending radially inwardly at an oblique angle from the inner face of the cylindrical wall 19. The rim 22 extends continuously around the circumference of the cylindrical wall 19. The converging faces are arranged at the same angle as the oblique faces of the rim 11 and shoulder 16.

The length of the reduced diameter portion 15 and thereby the spacing of the rim 11 and shoulder 16 is such that, when the nozzle 100 is in the open position, the inwardly extending rim 22 on the end cap 4 engages the rim 11, with the oblique face of the rim 11 engaging the upper oblique face of the rim 22 (as shown in FIG. 4); and such that, when the nozzle is in the closed position, the inwardly extending rim 22 on the end cap 4 engages the shoulder 16, with the oblique face of the shoulder 16 engaging the lower oblique face of the rim 22. By virtue of this arrangement, back flow of fluid between the outer surface of the nozzle body and the inner surface of the end cap is prevented.

A further benefit of the radially outwardly extending rim 11 may be that the engagement of the rim 22 therewith retains the end cap 4 on the nozzle body 1 with or without the addition of stop elements, as described below. With the threads fully unwound the rims 11, 22 will abut one another and permit continued rotation of the end cap 4 and body 1 relative to one another but prevent detachment of the end cap 4 from the body 1 by the rim 11 preventing upward axial movement of the rim 22 and thereby preventing detachment of the end cap 4.

To close the valve, from its open position shown in FIG. 4, the end cap 4 is screwed down on the nozzle body 1 by gripping the end cap 4 and rotating it. With such movement, the end cap travels downwardly in the axial direction and the closing member 6 of the nozzle body 1 is sealingly received within the opening 5 of the end cap 4. The end cap 4 may be provided with an annular sealing element, such as an elastomeric o-ring, or similar, around the opening 5 to increase sealing, or the closing member 6 may be provided with such a sealing element.

The base 3 of the nozzle body 1 is preferably permanently and sealingly attached to a fluid container, which is preferably a single use recyclable container. A suitable fluid container comprises a flexible bag, preferably formed from the same plastic as the nozzle body 1 and end cap 4. A container provided with the nozzle 100 may be transported empty and filled at the point of sale, most preferably in a vending machine, incorporating a filling mechanism as described below, which is arranged to dispense cold filtered water through a filling nozzle/needle.

Since the nozzle 100 is opened and closed by twisting, the handling of the nozzle during a filling operation is simplified. A simple and cost effective mechanism may be implemented in a manually operated or fully automated filling mechanism to open the valve before filling and to close the valve after filling.

Figure 5:
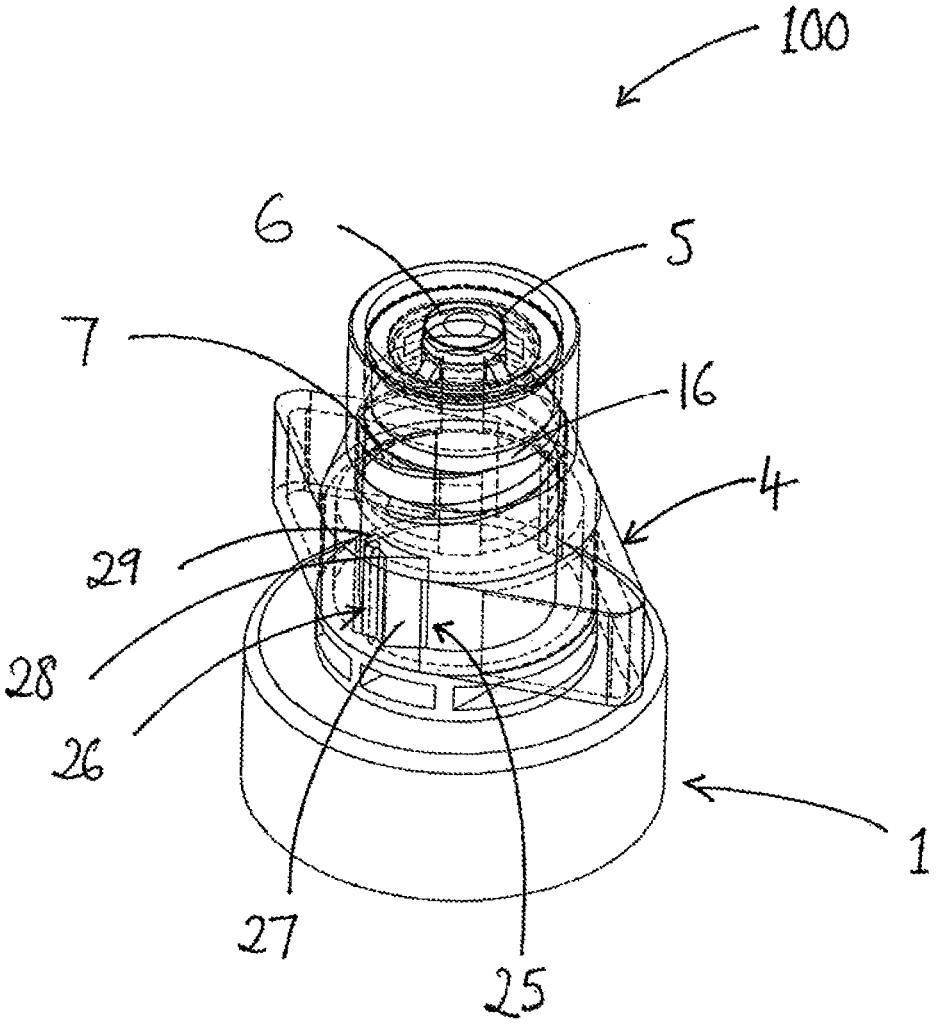
FIG. 5 shows a perspective view that shows a thread and locking arrangement.

Since the opening 5 of the nozzle 100 is small, the chance of unhygienic refilling by an end user is greatly reduced, particularly when, as is preferable, the nozzle 100 is provided with means that prevent the removal of the end cap 4 from the nozzle body 1. Such means preferably comprise an arrangement as shown in FIG. 5 and discussed below, however, alternative means will be readily appreciated. Moreover, when the end cap 4 and nozzle body 1 are permanently attached to one another the risk of choking by children is eliminated, and the environmental impact is reduced, since the end cap will be disposed of with the nozzle body.

Referring now to FIG. 5, there is shown an arrangement for preventing the removal of a nozzle cap 4 from a nozzle body 1, which may be used with any of the arrangements described herein. It should be appreciated that such an arrangement is not essential and need not be provided. The nozzle body 1 is provided with a pair of stop elements 25 and the end cap 4 is provided with a pair of stop elements 26.

The stop elements 25 on the nozzle body 1 are provided below the thread 7 on the outer face of the cylindrical wall 10. Each of the stop elements 25 comprises a ramp 27, a substantially wedge-shaped notch 28 and a planar face 29. The stop elements 25 are diametrically opposed to one another and are oppositely oriented.

The stop elements 26 on the end cap 4 are provided below the thread 8 on an inner face of the cylindrical wall 19. Each of the stop elements comprises a substantially wedge-shaped protrusion that corresponds in shape to the notches 28 provided in the stop elements 25. The stop elements 26 are diametrically opposed to one another and are oppositely oriented.

It should appreciated that in alternative arrangements the stop elements may be swapped over, with the stop elements 26 provided on the nozzle body 1 and the stop elements 25 provided on the end cap.

The arrangement of the stop elements is such that in a closed position, as shown in FIG. 8, each of the wedge-shaped protrusions 26 is received within a notch 28 of the corresponding stop element 25. As the end cap is rotated about the axis A relative to the nozzle body 1, the wedge-shaped protrusions of the stop elements 26 are urged out of the notches 28 and ride down the respective ramps 27, they slide over the outer surface of the cylindrical wall 10 until the point at which the wedge-shaped protrusions 28 contact the planar faces 29 of the respective stop elements 25. The planar faces 29 lie substantially perpendicular to the outer surface of the cylindrical wall 10, as compared to the ramps, which represent planar faces that lie at an oblique angle to the outer surface of the cylindrical wall. The arrangement of the planar faces 29 is such that stop elements 26 are unable to pass up over them. Detachment of the end cap 4 from the nozzle body 4 is thus prevented and in this manner the end cap 4 is permanently attached to the nozzle body 1.

As the end cap is rotated back from the open position to the closed position, the stop elements 26 slide over an outer surface of the cylindrical wall 10 until they reach the ramps 27. The stop elements 26 ride up the ramps before entry into the notches 28 of the stops 25, and a tactile feedback is provided to the user.

The stop elements need not take the described form. Alternative stop arrangements or means for preventing detachment of the end cap 4 from the nozzle body 1 will be readily appreciated.

Also illustrated in FIG. 5 is a split thread. The thread on the nozzle body 1 is broken in a line extending through the thread in the axial direction. This modification may be made to any of the threads described above. The purpose of the split thread is to better enable the end cap 4 to be driven down onto the nozzle body 1 into the nozzle closed position, as depicted, during manufacture of the nozzle and prior to filling.

Referring to FIGS. 6 to 11, there is shown a filling mechanism 200, which is suitable for filling a container that features a nozzle as described above.

The filling mechanism 200 comprises rotation means 30, adapted to effect rotation of the nozzle body 1 and the end cap 4 relative to one another, and a filling tube 32; the filling mechanism is arranged such that the filling tube 32 and the fluid opening 5 in the end cap 4 of the nozzle are brought into fluid communication with one another (as seen most clearly in FIG. 8*a*) by rotation of the nozzle body and end cap relative to one another. Note that fluid communication does not require that the nozzle and end cap engage one another, however, such engagement, as shown in FIG. 8*a*, is preferred.

The filling mechanism 200 is, broadly, arranged to: receive the nozzle in the first, closed, position (see FIGS. 6, 7, 7*a* and 9); apply a rotational force to the end cap, by the rotation means 30, to place the nozzle in the second, open position (see FIGS. 8, 8*a* and 10); dispense a predetermined volume of fluid from the filling tube through the opening in the end cap of the nozzle (the volume of fluid being predetermined in dependence of the volume of the container that is attached to the nozzle); and apply a counter-rotational force to the end cap, by the rotation means, to return the nozzle to the first, closed, position for subsequent release from the filling mechanism.

The filling mechanism comprises a housing 31. The position of the filling tube 32 may be fixed. That is, its location and orientation may be fixed within the housing and relative to all other components of the filling mechanism. The filling tube may alternatively be mounted such that its orientation is fixed but such that it may move up and down, towards and away from the end cap, (along its axial direction) within a predetermined range of movement. The filling tube may be resiliently biased towards the end cap (i.e. downwards). The filling tube is, in either case, however, spaced from the end cap prior to rotation of the end cap and nozzle relative to one another. With rotation of the nozzle end cap, by the rotation means 30, the nozzle end cap is moved axially (upwards as viewed in the figures) along the axis A, relative to the nozzle body, such that the end cap may engage the fixed filling tube. Accordingly, the filling tube is arranged to engage the end cap when the nozzle is in the second, open, position only. It is preferable that the filling tube 32 sealingly engages with the opening in the end cap when the nozzle is in the second, open, position (as seen most clearly in FIG. 8*a*). Where the filling tube is resiliently biased, as mentioned above, the end cap will apply a counter force to the filling tube against the biasing force (i.e. urging the filling tube upwards against the biasing means), such that suitable sealing engagement between the filling tube and end cap is enhanced. With or without a biased filling tube, the outer surface of the filling tube may be tapered at the leading edge of the filling tube to enhance engagement with the end cap of the nozzle. Such a tapered end 50 is shown in FIG. 7*a*.

The filling tube is fluidly connected to a fluid supply.

During the filling operation, the nozzle body has its position fixed with a locking mechanism 33 that engages the nozzle body. The locking mechanism 33 will now be described in detail. It should be noted that the locking mechanism is not limited to the following described arrangement. Various alternative arrangements will be readily appreciated by those skilled in the art. Moreover, the locking mechanism described in relation to the arrangement of FIGS. 12 to 17 may replace the presently described locking arrangement in the present arrangement.

The locking mechanism is arranged to lock the nozzle body such that its axis (axis A) lies on a main axis (axis X) of the filling mechanism, upon which the filling tube 32 lies. In this manner the filling tube 32 and the opening 5 in the end cap are locked in axial alignment for the filling operation. Moreover, the spacing of the nozzle body from the filling tube along the main axis (axis X) is fixed at least prior to rotation of the nozzle body and end cap relative to one another.

The locking mechanism is positioned below the rotation means 30. The locking mechanism comprises a pair of opposed locking plates (shown most clearly in FIG. 11), which lie in the same plane (as shown, for example, in FIG. 6) and substantially parallel to one another. The locking plates are spaced from one another by a predetermined distance. The locking plates are each pivotally mounted about a pivot point 35 that has its axis perpendicular to the plane in which the locking plates lie. The locking plates combine to form jaws for engaging the nozzle body. The locking plates are resiliently biased towards one another by a spring or similar means (not shown).

The opposed front corners 36 of the locking plates, which lie at the front side of the filling mechanism (as shown, for example, in FIGS. 9 and 10) are cut away to form an opening (or mouth) for receiving the nozzle body. As shown most clearly in FIG. 11, the opening is tapered to narrow towards the rear of the locking plates. Behind the cutaway corner, each plate is provided with a curved cutout 37. The cutouts oppose each other and combine to form a circular opening 38. The opening 38 is arranged with its centre on the main axis (axis X), which is perpendicular to the plane in which the locking plates lie. The opening is arranged to grip the neck of the nozzle body.

Towards the rear of the locking plates and behind the pivot points these is provided a locking element. In the present arrangement this comprises a pin 42 that has a diameter substantially equal to the distance between the plates. In the locked position, as shown in FIG. 11, the pin prevents the plates pivoting about the pivot points towards one another at the rear and away from one another at the front. The pin is preferably operated by a solenoid.

The nozzle body for use with the present locking arrangement has an annular neck 39 and a pair of collars 40. The spacing between the collars is substantially equal to the thickness of the locking plates 34. The diameter of the annular neck (or at least the portion that lies between the collars 40) is substantially equal to the diameter of the circular opening 38.

The arrangement of the locking mechanism is such that when the nozzle body is introduced between the locking plates, through the tapered opening (mouth), the plates are urged apart at the front by the neck of the nozzle body moving between the plates towards the rear of the plates. The locking plates pivot about their pivot points, since the locking pin is not present between the locking plates at this time. Once the neck of the nozzle body reaches the circular opening, the biasing force urges the plates back towards one another. Means may be provided for preventing the nozzle body being pushed any further back towards the rear of the plates. Such means may comprise a stop element or otherwise.

Once the nozzle body is in situ within the circular opening 38, the pin is introduced between the plates (as shown in FIG. 11), which locks the nozzle body in position and in axial alignment with the main axis (axis X). Up and down movement (movement of the nozzle body in the axial direction) is prevented by the collars 40, which sandwich the locking plates in the axial direction.

It is preferable that the locking pin is operated automatically when the neck of the nozzle body is correctly located in the circular opening 38. Operation of the locking pin may be implemented by a micro switch or by any other suitable means. Numerous suitable switching means will be apparent to those skilled in the art. In an alternative, the locking pin may be automatically operated as the rotation means is activated. This again may be with a micro switch, which could be operated with the handle or otherwise.

The rotation means 30 will now be described in detail. It should be noted that the rotation means is not limited the following described arrangement. Various alternative arrangements will be readily appreciated by those skilled in the art. In particular, whilst a manually operated rotation means is described, the rotation means may alternatively be fully automated. A motor may be provided to effect rotation, as for example described below with respect to the arrangement of FIGS. 12 to 17. Furthermore, alternative rotation elements to the one described may be provided to bring about the required rotation of the end cap and nozzle body relative to one another.

Figure 6:
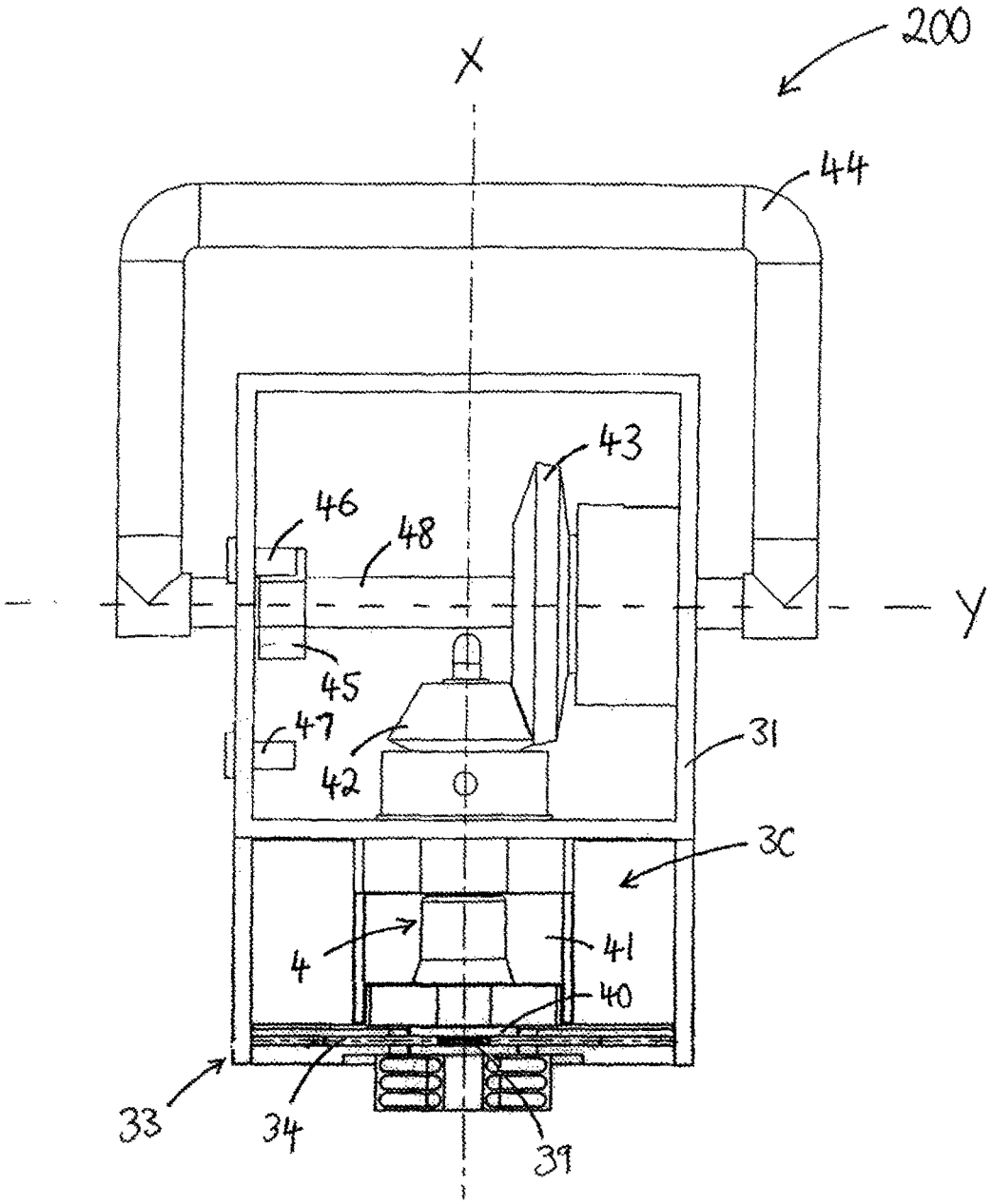
FIG. 6 shows a front view of a filling mechanism with a nozzle in situ.

The rotation means 30 comprises a rotation element 41, which is arranged to engage the end cap in use. The rotation element is open at its front side, which faces outwards at the front of the filling mechanism, as shown in FIGS. 6 and 9. By this arrangement, the nozzle body may easily be brought into contact with the rotation element. The rotation element 41 is located above the locking mechanism and the centers of the rotation element and the mouth of the locking mechanism are aligned. The rotation element preferably conforms to the profile of the rear of the end cap of the nozzle, in use. In the present arrangement, as described above, the base 18 of the end cap comprises a pair of radially extending protrusions 21*a*, 21*b*, which combine to give the base 18 a substantially diamond-like shape in plan view. Here, the profile of an inner face of the rotation element in plan view is substantially V-shaped to conform to one half of the diamond-like shape formed by the radial protrusions of the end cap.

The inner face of the rotation element 41, which engages the end cap and applies a rotation force to the nozzle, may be provided with a high friction coating to increase grip, such as rubber.

The rotation element 41 is arranged to rotate about the main axis (axis X) of the filling mechanism. Any conventional means may be adopted to achieve rotation of the rotation element.

In the present arrangement the rotation element is operatively connected to a bevel gear 42 that lies on the main axis (axis X). The bevel gear 42 is rotated by a second bevel gear 43 that lies on a secondary axis of rotation (axis Y) that is perpendicular to the main axis (axis X). The second bevel gear 43 is operatively connected to a handle 44, which is arranged to rotate about the secondary axis of rotation (axis Y). The handle, as shown in FIGS. 6 and 7, is substantially U-shaped, however, may take any suitable alternative form. The bevel gears are arranged such that with rotation of the second bevel gear through 90 degrees, the first bevel gear (and thereby the rotation element 41) is rotated through 180 degrees. With rotation through 180 degrees the nozzle is moved from the first, closed, position into the second, open, position and vice versa.

Means are preferably provided for limiting the rotation of the handle. In the present arrangement a shaft 48 on which the second bevel gear 43 is mounted is provided with a cam-like element 45 that protrudes radially from the shaft and limits rotation of the shaft between two pins 46, 47 that abut the cam-like element at the prescribed limits of rotation. As will be readily appreciated by those skilled in the art, numerous alternative means of limiting rotation may be implemented.

Means are preferably provided for controlling the dispensing of fluid through the filling tube. Switch means are preferably provided for dispensing a predetermined volume of fluid when the nozzle reaches the second, open, position. Means may further be provided for either switching off the flow of fluid if the rotation means is counter-rotated before the predetermined volume of fluid has been dispensed, or for locking the rotation means to prevent counter-rotation before the predetermined volume of fluid has been dispensed.

It should be noted that whilst the perspective views of FIGS. 9 and 10 show the front of the filling mechanism to be open with the working exposed there will ordinarily be a cover provided to conceal the workings.

Referring to FIGS. 12 to 17, there is shown an alternative filling mechanism 300, which is, again, suitable for filling a container that features a nozzle as described above. This filling mechanism 300 is, broadly, functionally identical to the above described filling mechanism 200. The filling mechanism 300 differs principally from the filling mechanism 200 in that rather than being configured for manual operation it is powered. That is, the force to turn the rotation element 41 of this arrangement is provided by a motor as opposed to manual effort. Components common to this arrangement 300 and the above described manual arrangement 200 will not be discussed in detail here.

A motor 301 is provided to provide a turning force to the rotation element 41. The force may be transmitted to the rotation element through gears or belts or any other transmission means. In the depicted exemplary arrangement, a gear 302 is operatively connected to the rotation element in axial alignment with the axis of rotation thereof (axis X). Gear 302 is rotated by a gear 302*a* connected to the axle of the motor.

The locking mechanism of this arrangement comprises a locking plate 303, as a first locking member, and pivoting door 304, as a second locking member. It should be appreciated, however, that the locking arrangement described above, which comprises a pair of pivotal plates, or any suitable alternative locking mechanism, could be used with a motor driven filling mechanism as described herein.

The locking plate is provided with a cutout for receiving the nozzle. The cutout provides an open mouth 305 at the front of the plate that tapers outwardly. The cutout terminates at its rear in a semi-circle (not shown), which is arranged with its centre on the main axis (axis X), which is perpendicular to the plane in which the locking plate 303 lies. The semi-circle is arranged to receive the neck of the nozzle body.

The nozzle body for use with the present locking arrangement, as described with respect to the earlier arrangement, has an annular neck 39 and a pair of collars 40. The spacing between the collars is substantially equal to the thickness of the locking plate 303. The diameter of the annular neck (or at least the portion that lies between the collars 40) is substantially equal to the diameter of the semi-circular opening.

It should be noted that the shape of the cutout will be adapted to conform to the profile of the nozzle body as appropriate. The same applies to the cutout in the door, as described below.

The door pivots about an axis that is parallel to the main axis (axis X) of the filling mechanism. The door is provided with a cutout 306, which, when the door is closed, is arranged to engage a front of the nozzle body, to thereby trap the nozzle body between opposed cutouts of the door and the locking plate. By this arrangement, the nozzle body is locked in position and in axial alignment with the main axis (axis X). Up and down movement (movement of the nozzle body in the axial direction) is prevented by the collars 40, which sandwich the locking plate in the axial direction.

There is preferably means provided for locking the door in the closed position. Such means may comprise a solenoid or electromagnet. Numerous suitable alternative means will, however, be readily appreciated by those skilled in the art. The locking means is preferably activated automatically upon closing the door. A micro switch 307 is shown in the figures. This switch is preferably linked to a micro controller for controlling the locking means as well as the other operations of the filling mechanism, as discussed below.

In addition to its use as part of the locking mechanism, the door provides for safe operation of the filling mechanism by preventing the insertion of fingers or other foreign bodies into the filling mechanism during operation.

FIG. 16 shows the nozzle in an open position, following rotation of the end cap by the rotation element 41, with the end cap thus raised into engagement with the end of the filling tube. The filling tube 32 in this arrangement is mounted such that its orientation is fixed but such that it may move up and down, towards and away from the end cap, along the main axis (axis X), within a predetermined limited range of movement. A spring (or similar biasing means) (not shown) is provided to bias the filling tube downwards into its lowermost position. The filling tube is provided with a collar 308, which is arranged to engage a micro switch (or similar switching element) when the filling tube is raised up by engagement with the filling tube. If the movement of the filling tube along its axis is outside a predetermined range, sensed by the operation of the micro switch, then it is determined that the engagement of the filling tube with the end cap is not correct. It should be noted that the end of the filling tube is preferably tapered as discussed with respect to FIG. 8*a*.

Means are preferably further provided for preventing re-filling of fluid containers. The nozzle is provided with a tab 310 that protrudes radially outwardly. The tab is arranged at the rear of the nozzle as it is introduced into the filling mechanism. The tab is formed from plastic and is preferably integrally moulded with the nozzle body.

The filling mechanism is provided with a switching element 311, such as a micro switch, which is operatively engaged (directly or indirectly) by the tab when the nozzle is introduced into the filling mechanism to be filled. The switching element is preferably activated when the nozzle is aligned with the main axis (axis X), i.e. when the nozzle is in situ, ready for filling, as shown in FIG. 17 for example. This switching element is preferably linked to the micro controller for preventing/allowing a filling operation, as discussed below.

An element 312 is provided to break off the tab once the switching element has been operatively engaged. In the present exemplary arrangement this comprises an arm, which rotates about a pivot point to break the tab from the nozzle body. It should be appreciated, that the tab may be bent, snapped off, sheared off or otherwise permanently damaged/deformed. What is required is that were the nozzle reintroduced following such damage/deformation of the tab, the tab would not activate the switching element. Whilst an arm is shown that pivots, numerous alternative mechanisms will be readily appreciated. For example, a solenoid could be provided to damage/deform the tab.

It should be noted that the filling tube or re-filling prevention means, as described above with respect to the motor driven filling mechanism 300 may be integrated into the manual filling mechanism 200, wherein means may be provided to alert an operator to a misengagement of the filling tube with the end cap or the attempted re-filling of a previously used container; or to prevent re-filling.

Operation of the filling mechanism 300 will now be described. The filling operation is controlled by a microcontroller, which receives inputs from all of the micro switches/switching means described.

The door 304 of the locking mechanism is opened and the nozzle of a container to be filled is inserted into the mouth 305 of the locking plate 303 of the locking mechanism. The door 304 of the locking mechanism is then closed to lock the nozzle in place. Closing the door activates the micro switch 307. The locking means, which may comprise a solenoid, electromagnet, or otherwise, is activated following activation of the micro switch 307 to lock the door shut. Closing the door may trigger the sequence for filling the container.

Alternatively, there may be a push button, or other switch, for starting the filling sequence, which must be pressed by a user following closing of the door.

With the door shut, it is detected by activation (or not) of the switching element 311 whether the tab 310 is present (or not), wherein if the tab is not present the microcontroller will prevent continuation of the filling operation and will activate a notification means, such as a warning light and/or audible warning to notify the user of such. Assuming the tab is present, the microcontroller will activate the tab damage/deformation mechanism to suitably damage/deform the tab and will proceed with the filling operation.

It should be noted that this damage/deformation step may alternatively occur at the end of the filling sequence, i.e. following the filling operation.

The microcontroller will next activate the motor to effect rotation of the rotation element, which will bring the end cap into contact with the filling tube. This will raise the filling tube and cause engagement of the micro switch (or similar switching element). If the movement of the filling tube along its axis is outside a predetermined range, sensed by the operation of the micro switch, then it is determined that the engagement of the filling tube with the end cap is not correct and the microcontroller will prevent continuation of the filling operation and will activate a notification means, such as a warning light and/or audible warning to notify the user of such. Assuming the engagement is correct, the microcontroller will instruct the release of a predetermined volume of fluid through the filling tube.

Once filled, the rotation element will be rotated back to close the nozzle and the locking means will be released to allow for removal of the filled container.

Further preferred arrangements will be fully automated. These may include filling mechanisms that are located within vending machines. Such arrangements may be fed with magazines of containers, preferably pouches as described above, which are fed in turn to the filling mechanism, as required.

Any of the arrangements discussed are ideally suited to filling nozzles that are provided on pouches.

Features of the various disclosed arrangements may be taken in combination with one another. Alternative arrangements, within the scope of the claims that follow, will be readily appreciated by those skilled in the art.

The invention claimed is:

1. A filling mechanism for use with a nozzle, the nozzle comprising a nozzle body and an end cap, which are axially aligned with one another, the end cap comprising a fluid opening and the nozzle body comprising a closing member, wherein in a first, closed, position the closing member is arranged to seal the opening, and in a second, open, position the opening is spaced from the closing member, so as to allow the flow of fluid through the opening, and the end cap and nozzle body are interconnected such that axial movement of the end cap relative to the nozzle body, between the first and second positions, is achieved by rotation of the nozzle body and the end cap relative to one another about the axis;

the filling mechanism comprising a filling tube and a rotator that effects rotation of the nozzle body and the end cap relative to one another, the rotator comprising a rotation element that is operatively connected to the end cap;

the filling mechanism being arranged such that the filling tube and the fluid opening in the end cap of the nozzle are brought into fluid communication with one another by rotation of the nozzle body and end cap relative to one another.

2. A mechanism as claimed in claim 1, wherein the rotator is arranged to apply a rotational force to the end cap.

3. A mechanism as claimed in claim 1, wherein the position of the filling tube is fixed.

4. A mechanism as claimed in claim 1, wherein the orientation of the filling tube is fixed.

5. A mechanism as claimed in claim 1, wherein the filling tube is maintained in spaced relation to the end cap prior to rotation of the nozzle body and end cap relative to one another.

6. A mechanism as claimed in claim 1, wherein the filling tube is arranged to engage the end cap only when the nozzle is in the second, open, position.

7. A mechanism as claimed in claim 6, wherein the filling tube is arranged to sealingly engage with the opening in the end cap when the nozzle is in the second, open, position.

8. A mechanism as claimed in claim 6, wherein a sensor is provided, which is arranged to sense correct engagement of the filling tube with the end cap.

9. A mechanism as claimed in claim 1, wherein the filling tube is mounted such that it may move away from the end cap along its axial direction and is resiliently biased towards the end cap, wherein with rotation of the nozzle body and end cap relative to one another, the end cap and filling tube are brought into engagement with one another and the end cap applies a counter force to the filling tube against the biasing force.

10. A mechanism as claimed in claim 1, further comprising a locking mechanism that is arranged to engage the nozzle body to lock the position of the nozzle body, the locking mechanism comprising a plate and a pivoting door.

11. A mechanism as claimed in claim 10, wherein the locking mechanism is arranged to lock the nozzle body at a predetermined distance from the end of the filling tube, prior to relative rotation of the end cap and nozzle body relative to one another, and to maintain the opening in the end cap in axial alignment with the filling tube.

12. A mechanism as claimed in claim 1, which is arranged to:

a) receive the nozzle in the first, closed, state;

b) apply a rotational force to the end cap to place the nozzle in the second, open position;

c) dispense a predetermined volume of fluid from the filling tube, through the opening in the end cap of the nozzle; and d) apply a counter-rotational force to the end cap to return the nozzle to the first, closed, position.

13. A mechanism as claimed in claim 1, wherein the rotation element is arranged to engage the end cap on one half of the end cap only, such that the rotation element is open on one side and the nozzle may be brought into engagement with the rotation element by translational movement of the nozzle in a direction substantially perpendicular to the axis of the filling tube.

14. A mechanism as claimed in claim 1, wherein the rotator is arranged to limit rotation of the nozzle body and end cap relative to one another within predetermined limits.

15. A mechanism as claimed in claim 1, wherein the rotator is motor driven.

16. A mechanism as claimed in claim 1, comprising means for preventing refilling of a container provided with the nozzle.

17. A mechanism as claimed in claim 1, further comprising a locking mechanism that is arranged to engage the nozzle body to lock the position of the nozzle body, the locking mechanism comprising a pair of pivoting plates.

18. A mechanism as claimed in claim 17, wherein the locking mechanism is arranged to lock the nozzle body at a predetermined distance from the end of the filling tube, prior to relative rotation of the end cap and nozzle body relative to one another, and to maintain the opening in the end cap in axial alignment with the filling tube.

* * * * *